United States Patent [19]

Ho

[11] Patent Number: 4,783,881

[45] Date of Patent: Nov. 15, 1988

[54] DOOR CLOSING DEVICE WITH A BELT-SHAPED SPIRAL SPRING

[76] Inventor: Shi C. Ho, No. 31, Fan She Street, 1 Lin, Fan She Tseng, Fu Shin Hsiang, Chang Hua Hsien, Taiwan

[21] Appl. No.: 721,390

[22] Filed: Apr. 9, 1985

[51] Int. Cl.[4] ..... E05F 1/08

[52] U.S. Cl. ..... 16/72; 188/83

[58] Field of Search ..... 16/72, 71, 76, 77, DIG. 17, 16/10, 299, 300, 335-337; 188/83

[56] References Cited

U.S. PATENT DOCUMENTS

| | | | |
|---|---|---|---|
| 392,667 | 11/1888 | Devore | 16/77 X |
| 1,055,110 | 3/1913 | White | 16/336 |
| 1,588,349 | 6/1926 | Ztacnik | 16/77 |
| 2,895,779 | 7/1959 | Bender | 16/77 X |
| 3,533,127 | 10/1970 | Hoober | 16/76 |
| 3,778,866 | 12/1973 | Nakanishi | 16/76 |
| 4,419,787 | 12/1983 | Lieberman | 16/76 X |

FOREIGN PATENT DOCUMENTS

| | | | |
|---|---|---|---|
| 633263 | 10/1927 | France | 16/77 |
| 254160 | 7/1926 | United Kingdom | 16/76 |
| 490084 | 8/1938 | United Kingdom | 16/337 |

*Primary Examiner*—E. R. Kazenske
*Assistant Examiner*—James L. Wolfe
*Attorney, Agent, or Firm*—Sandler & Greenblum

[57] ABSTRACT

A door closing device utilizing the elastic restoring force of a belt-shaped spiral spring to effect the closing of a door which comprises a housing having one portion fixed a door or a door frame; a reel rotatably disposed in the housing; a belt-shaped spiral spring wound on the reel having an end portion extending out from the housing with the end portion fixed to a door frame or a door.

7 Claims, 5 Drawing Sheets

DOOR CLOSING DEVICE WITH A BELT-SHAPED SPIRAL SPRING

BACKGROUND OF THE INVENTION

The present invention relates to a door closing device, and particularly to a door closing device which utilizes a belt-shaped spiral spring to operate a door so that the closing device can be made more compact than the usual one.

Most of the known door closing devices are designed by making use of the elastic restoring force of a coil spring to effect the closing of a door, and usually the regulation and buffering of the closing speed and the working force is controlled by means of a lever or an oil pressure cylinder.

However, when one tries to make a more compact door closing device which utilizes the elastic restoring force of a coil spring, he must use a smaller coil spring. Unfortunately, a small coil spring sometimes does not have sufficient restoring force for closing a door, and therefore, one cannot avoid using a large coil spring for a door closing device, which then results in having to use a larger casing for accommodating the coil spring. Therefore, it is difficult to make the known door closing device more compact.

In addition, a known door closing device also uses a lever or a oil pressure cylinder for regulating and buffering the closing speed and the working force of the coil spring, which is inevitably increases the size of the door closing device. Additional shortcomings of the known door closing device include the fact that the means used for regulating and buffering the closing speed and working force in a liquid operated door closing device is usually complicated, and when the weather is cold, the flowability of the operating liquid may be reduced.

SUMMARY OF THE INVENTION

It is therefore an object of the present invention to provide a compact door closing device which utilizes a belt-shaped spiral spring to obtain the elastic retoring force so that by only slightly increasing the width of the belt-shaped spring, a large elastic restoring force is obtainable, and therefore, the size of the housing for receiving the spiral spring can be made small. In addition, by providing a braking means which utilize the abrasive resistance with the housing, the closing speed and the working force can be easily regulated and buffered.

In order to attain the above-mentioned objectives, the door closing device of the present invention comprises: a housing having a portiuon adapted to be fixed to one of a door and a door frame; a reel rotatably disposed in the housing; a belt-shaped spiral spring wound on the reel having an end portion extending out from the housing with the end portion adapted to be fixed to the other one of the door and the door frame, so that when a door opening force is applied on the end portion of the belt-shaped spiral spring, an elastic restoring force is produced for effecting the closing of the door. In accordance with an aspect of the present invention, the door closing device further comprises a braking means mounted in the housing for regulating the rotation of the reel.

In accordance with another aspect of the present invention, the braking means comprises a plate and two strips upwardly provided at the plate with the upper end of the two strips abutting against the inner periphery surface of a bushing which is fixed in the reel.

The details of the present invention are described in connection with the following drawings, wherein:

DETAILED DESCRIPTION OF THE PREFERRED EMBODIMENT

Figure 1:
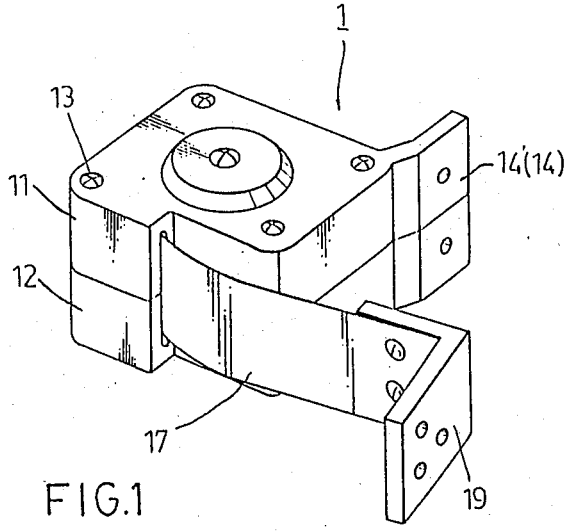
FIG. 1 is a schematic perspective view of a preferred embodiment of the present invention.

Referring to FIG. 1, the door closing device of the present invention includes a housing upper portion 11, a lower portion 12 and a door closing means 17 contained in the upper portion and lower portion (in the FIG. 1, only a portion of the closing means 17 is shown). The upper portion 11 and lower portion 12 are connected together by four screw bolts 13. The housing portion 11,12 are mounted on a door or a door frame(not shown in FIG. 1) with an L-shaped angle plate 14(14') which is integrally formed at the upper portion 11 or the lower portion 12.

Figure 2:
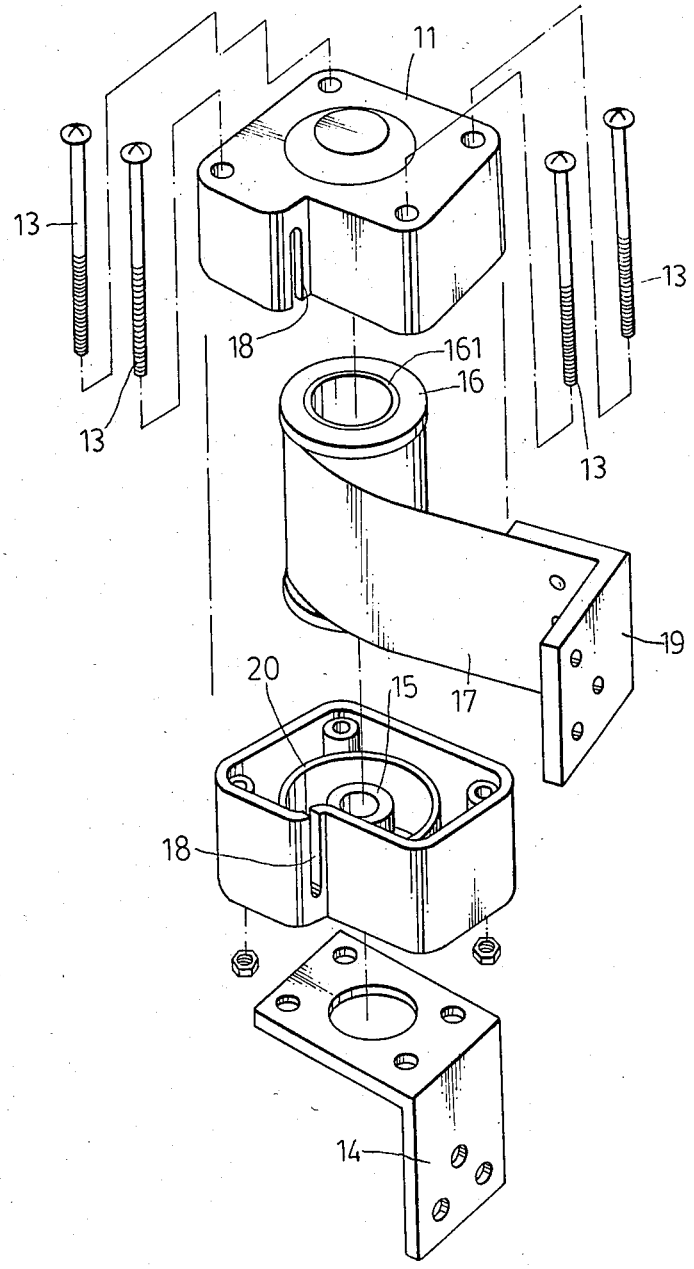
FIG. 2 is a exploded view of another embodiment of the present invention.

Now referring to FIG. 2, which is a schematic view of another preferred embodiment of the present invention, the door closing means in the housing is a belt-shaped spiral spring 17 winding around a hollow cylindrical reel 16. One end of the belt-shaped spiral spring 17 is extending out from a slot 18 formed on the housing portion 11,12 and is provided with a L-shaped angle plate 19. In principle, the winding reel 16 is installed in the housing portion 11,12, in the direction with the rotation axis of the door.

The hollow cylindrical reel 16 is rotatably disposed on the supporting seat 15. For the purpose of preventing the spiral spring 17 wound on the reel 16 from being detached, around the reel 16, a circular wall 20 is enclosed.

Figure 6A:
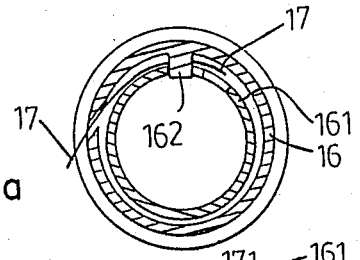
FIG. 6*a* is a horizontal sectional view showing how the end portion of the belt-shaped spiral spring is hung on the winding shaft.
Figure 6B:
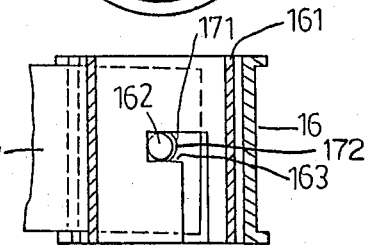
FIG. 6*b* is a vertical sectional view of FIG. 6*b*.

As the belt-shaped spiral spring 17 is wound on the reel 16, and the reel 16 is supported by the supporting seat 15, when the spiral spring 17 is pulled out along a tangent direction by applying a door opening force on the angle plate 19, an elastic restoring force concurrently occurs. When the door opening force disappears, the elasic restoring force generated will effect the closing of the door. In addition, as shown in FIGS. 6*a*, 6*b*, at one end 171 of spiral spring 17, an opening 172 is formed, and a short protrusion 162 is radially protruding out from the inner wall of the hollow cylindrical reel 16. Therefore, by engaging opening 172 with the protrusion 162, the end 171 of the belt-shaped spiral spring 17 is retained on the reel 16. Further, a bushing 161 is disposed in the hollow reel 16 by engaging an opening 163 formed on inner lateral wall with protrusion 162 for preventing the spiral spring 17's detachment from the protrusion 162. It is noted that the bushing 161 is rotatable with the hollow reel shaft 16.

Figure 3:
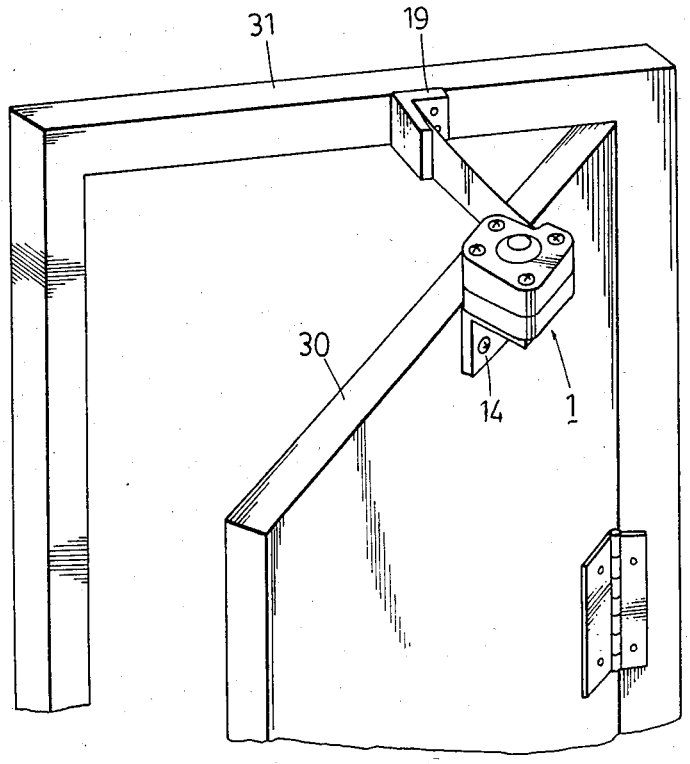
FIG. 3 is a schematic view showing that the door closing device of FIG. 2 is mounted on a door and a door frame to effect the closing.

Now referring to FIG. 3, which shows that the door closing device of the present invention is installed by fixing angle plate 19 on a door frame 31, and angle plate 14 of the housing body on the upper portion of the door 30. Naturally, by fixing angle plate 19 on the upper portion of door 30 and angle plate 14 of housing body 1 on the door frame one can also effect the closing function. In addition, when the door closing device of the present invention is installed, even though the axis direction of the reel 16 is not parallel with the axis direction of the door, the door closing function is also attainable.

Figure 4:
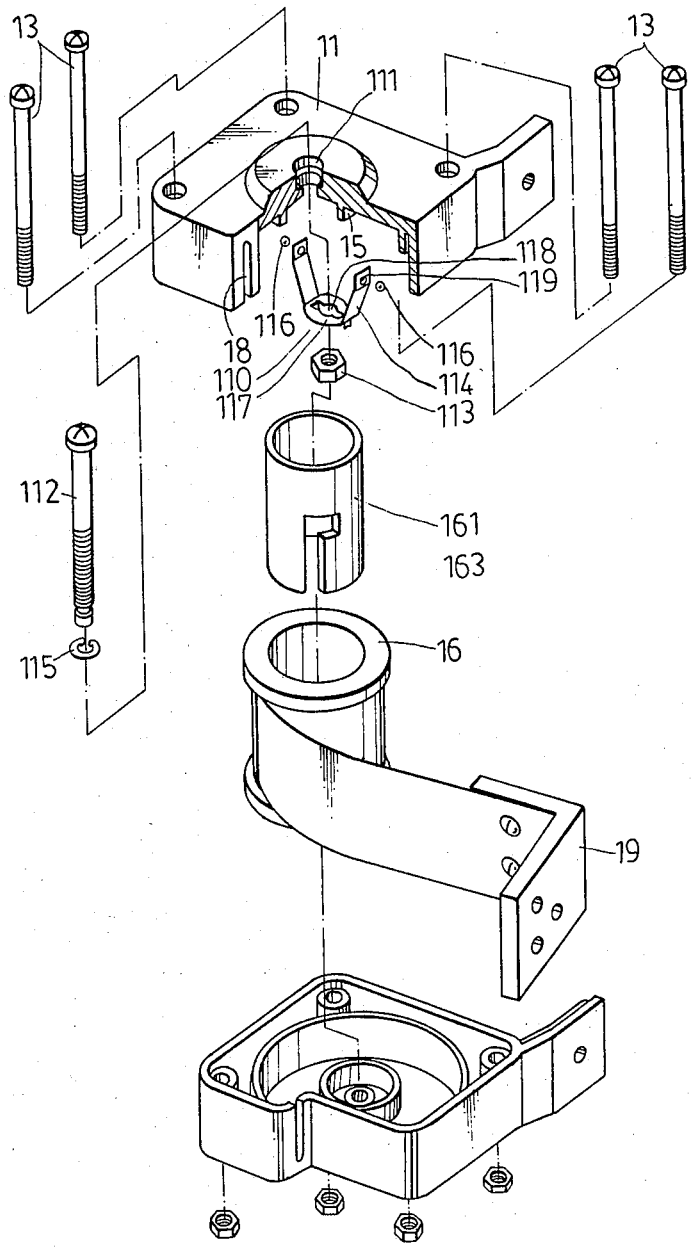
FIG. 4 is an exploded view of the door closing device of FIG. 1 showing particularly a braking means that is mounted in the housing.

FIG. 4 is an exploded view of the door closing device of FIG. 1, which particularly shows the abrasive braking means of the device.

In FIG. 4 is shown an abrasive braking member 110 which includes a thin metallic plate 117 having a hole 118, two flexible metallic strips 114,114 integrally and oppositely formed at the edge of said plate 117, two small steel balls 116,116 received respectively in two dented portions 119 formed at the end of two strips 114,114, respectively. Bolt 112 is screwed so that it passes through screwing hole 111 ,hole 118 and a nut 113 to fix said braking member 110 on the housing upper portion 11, and the steel balls 116,116 are forced to abut against the inner periphery surface of the bushing 161 so as to effect the braking of the rotation of the bushing 116 and the reel 16, i.e. the elastic restoring force of the spiral spring 17.

Figure 5:
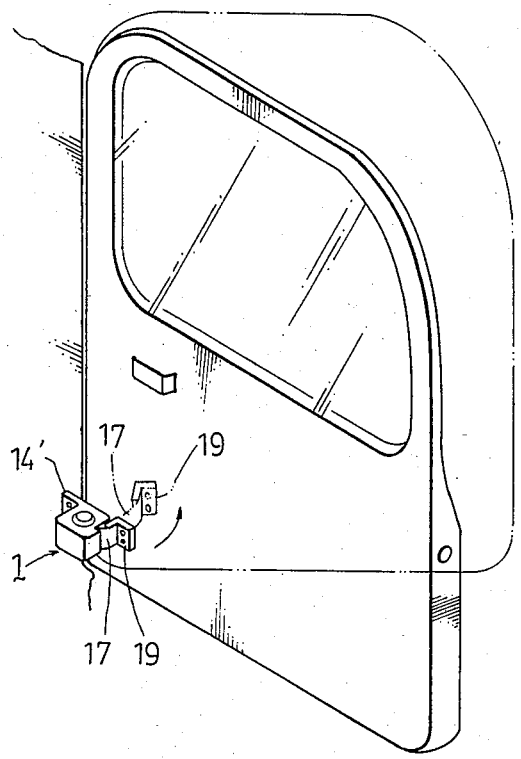
FIG. 5 is a schematic view showing that the door closing device of the present invention is utilized in the door of a car.

FIG. 5 shows that the door closing device of the present invention is used in a door of a car.

Therefore, according to the present invention, by using the elastic restoring force of a belt-shaped spiral spring, not only the volume of the housing can be made more compact, the cost of the device can also be reduced. With the invention thus explained, it is apparent that obvious modifications and variations can be made without departing from the spirit and scope of the invention, and it is therefore intended that the invention be limited only as indicated in the appended claims.

What is claimed is:

1. A door closing device, comprising:

(a) a housing adapted to be mounted to one of a door and a door frame, said housing comprising an upper portion and a lower portion connected to said upper portion by fastening means, each of said housing portions including a vertically extending slot along an exterior surface portion thereof;

(b) a hollow cylindrical reel rotatably disposed within said housing about a support member comprising a bushing;

(c) a belt-shaped spiral spring being wound on said reel and comprising a first end portion and a second end portion, said first end portion comprising means for mounting said spiral spring to one of said door and said door frame, and said second end portion being fixedly attached to said reel, wherein said slots, when said housing portions are assembled, mate with each other to form a larger slot, wherein said first end portion extends outwardly through said larger slot so that when a door opening force is applied to said first end portion, an elastic force is produced for effecting the closing of said door; and (d) braking means fixedly mounted to said housing, said braking means continuously abutting an interior surface of said bushing to regulate the rotation of said reel; wherein said braking means comprises a plate, a plurality of balls, and a plurality of upwardly and outwardly extending strips integrally mounted along the periphery of said plate, whereby the upper ends of said strips force said balls to abut against said interior surface of said bushing positioned within the center of the rotatable reel, to thereby regulate the rotation thereof.

2. The door closing device of claim 1, wherein the upper end of each of said strips comprises a depression to receive a respective one of said balls.

3. The door closing device of claim 1, wherein said means for mounting said spiral spring comprises an L-shaped bracket.

4. The door closing device of claim 1, further comprising an L-shaped member for mounting said housing on one of said door and door frame, whereby one arm of said L-shaped member is fixedly mounted to said lower portion of said housing and the other arm is fixedly mounted to one of said door and said door frame.

5. The door closing device of claim 1, wherein each said upper portion and said lower portion comprises a plate integrally attached at a corner thereof, each of said plates including at least one hole therein to mount said housing to one of said door and said door frame by mechanical fastening means.

6. The door closing device of claim 1, wherein a protrusion radially protrudes from an interior surface of said reel.

7. The door closing device of claim 6, wherein said second end portion of said spring and said bushing each comprises a slot to receive said protrusion therein to thereby retain said second end portion on said reel

* * * * *